US005287603A

United States Patent [19]

Schorman

[11] Patent Number: 5,287,603

[45] Date of Patent: Feb. 22, 1994

[54] STORAGE CONTAINER FOR HUMAN REMAINS AND METHOD THEREFOR

[76] Inventor: David C. Schorman, 8256 E. Arabian Trail #141, Scottsdale, Ariz. 85258

[21] Appl. No.: 853,075

[22] Filed: Mar. 17, 1992

[51] Int. Cl.[5] ..... A61G 17/00

[52] U.S. Cl. ..... 27/1; 27/35; 52/134; 52/136

[58] Field of Search ..... 52/134–137; 27/1, 35; 312/111–119

[56] References Cited

U.S. PATENT DOCUMENTS 2,513,951 7/1950 McClellen ..... 27/1
3,183,574 5/1965 Diem ..... 27/1
3,529,730 9/1970 Thompson ..... 27/1 X
4,073,100 2/1978 DiGiovanni, Jr. ..... 52/136
4,607,417 8/1986 Hancovsky ..... 27/1
4,614,066 9/1986 Koppenberg ..... 52/134

*Primary Examiner*—Carl D. Friedman
*Assistant Examiner*—Kien Nguyen
*Attorney, Agent, or Firm*—Harry M. Weiss

[57] ABSTRACT

This disclosure is directed to a storage container for human remains which comprises a bottom portion, a plurality of walls each having a bottom edge coupled to the bottom means, a rim portion, a cover which fits into a recessed portion of the rim portion, a retainer portion which retains the cover within the recessed portion, fastener means to fasten the retainer portion to the cover wherein the container contains ashed human remains.

25 Claims, 1 Drawing Sheet

STORAGE CONTAINER FOR HUMAN REMAINS AND METHOD THEREFOR

FIELD OF THE INVENTION

This invention pertains in general to storage containers and, in particular, to storage containers for human remains.

BACKGROUND OF THE INVENTION

It is obvious that knowledge and awareness of storage containers for human remains are integrated into almost every person's perception of the natural processes of life and death. In fact, a large part of human knowledge about life in the past and the development of various civilizations throughout the world come from the various kinds of storage containers for human remains which have endured mainly intact into the present. There have been many successful designs using a variety of materials as we can see by the various types of urns, crypts and coffins that exist in museums and collections. In spite of these successes, the ever evolving availability of new materials and manufacturing create new opportunities in the ways in which various items, including storage containers for human remains can be designed and made.

OBJECTS OF THE INVENTION

It is an object of this invention to provide an improved container for the storage of human remains.

It is a further object of this invention to show a method for providing an improved container for the storage of human remains.

It is still another object of this invention to provide an improved container for the storage of human remains which makes use of contemporary, inexpensive, easy-to-manufacture materials.

It is a further object of this invention to provide an improved container for the storage of human remains which uses contemporary, inexpensive, easy-to-manufacture materials such as plastic, plastic resin or other impregnated plastic compounds.

It is a further object of this invention to provide an improved container for the storage of human remains which uses contemporary, inexpensive, easy-to-manufacture materials such as plastic, plastic resin or other impregnated plastic compounds using automated manufacturing processes such as casting or injection molding.

SUMMARY OF THE INVENTION

According to the foregoing objectives, the present invention provides an improved container for the storage of human remains which uses contemporary, inexpensive, easy-to-manufacture materials such as plastic, plastic resin or other impregnated plastic compounds using automated manufacturing processes such as casting or injection molding.

Various other purposes and advantages of this invention will become clear from its description in the specifications that follow and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

Figure 1:
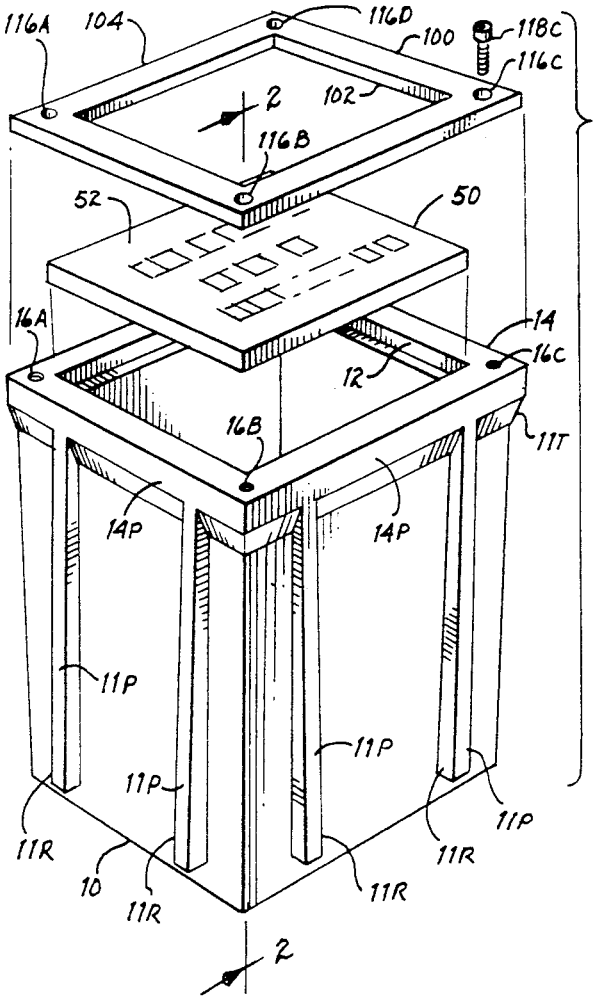
FIG. 1 shows an exploded isometric view of the storage container of the present invention.

Referring now to the drawings, wherein like parts are designated throughout with like numerals, FIG. 1 shows a storage container 10 according to the present invention. Storage container 10 includes a recessed portion 12 which is adapted to receive a lid or cover 50 which encloses and seals the top opening of storage container 10. Cover 50 is held securely in place by retaining ring 100. Retaining ring 100 has an inner periphery 102 and an outer periphery 104 of a size adequate to hold cover 50 securely within recess 102 while exposing an adequate amount of the top surface 52. Top surface 52 and the material chosen to make cover 50 are adapted to allow top surface 52 to be stamped, engraved, etched or otherwise marked to identify the contents and to allow whatever other decorations or messages that are desired. The top opening of storage container 10 has a rim portion 14 which is constructed with sufficient width and thickness to provide strength and rigidity to the top opening of storage container 10. The thickness of rim portion 14 allows it to house holes 16A, 16B, 16C and 16D (not shown) in each corner of the rim portion 10. Holes 16A, 16B, 16C and 16D are blind holes which in this embodiment contain a metal insert which is threaded to receive a screw-type fastener. Holes 16A, 16B, 16C and 16D can be otherwise adapted to use other types of fasteners or locking pins. Corresponding to holes 16A, 16B, 16C and 16D in rim portion 14 are holes 116A, 116B, 116C, and 116D in retaining ring 100. Holes 116A, 116B, 116C, and 116D are of sufficient size to allow fastening devices such as screw 118C shown in FIG. 1 and screws 118A and 118B shown in FIG. 2 to secure retaining ring 100 to the top surface of rim portion 14 which, in turn, secures plate 50 within recessed portion 12. The cross-sectional view of FIG. 2 shows the position of cover 50 within recess 12 and secured under retaining ring 100.

Figure 3:
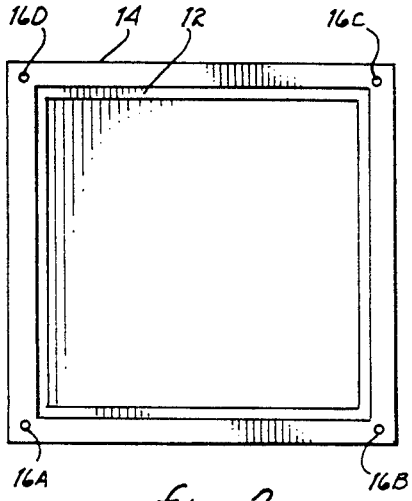
FIG. 3 shows a top view of the storage container of the present invention as viewed along the line 3—3 of FIG. 2.
Figure 2:
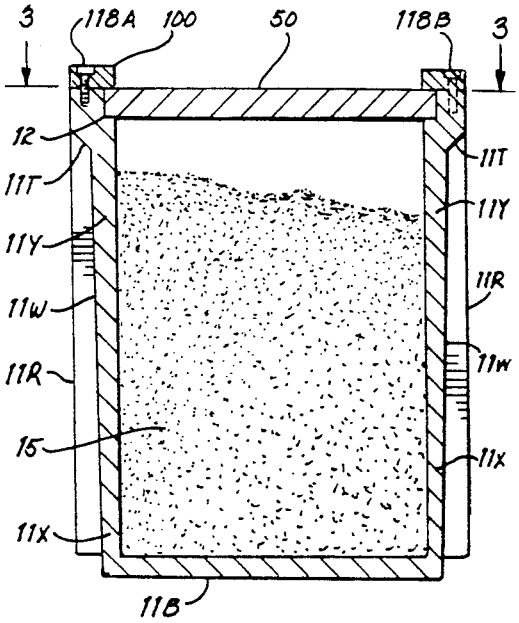
FIG. 2 shows cross-sectional view of the storage container of the present invention as viewed along the line 2—2 of FIG. 1.

Referring again to the cross-sectional view of FIG. 2 storage container 10 comprises a sealed hollow vessel which contains human remains 15, typically in the form of ashes resulting from cremation. The structure of storage container 10 comprises bottom portion 11B and a plurality of wall portions 11W which are joined at their edges to form the vessel structure of storage container 10. The relatively thinner wall portions 11W transition through a rim buttress portion 11T to join the relatively thicker rim portion 14 (see FIG. 3). FIG. 1 and FIG. 2 also show a plurality of rib members 11R coupled to the outer surfaces of wall portions 11W with each rib member 11R coupled at its top to the rim buttress portion 11T. The combined coupling of the wall portions 11W, the rim portion 14, the rim buttress portion 11T and the plurality of rib members 11R result in a total structure in which relatively thinner wall portions 11W can be used to achieve lightness and economy of material while the remaining rim portion 14, the rim buttress portion 11T and the plurality of rib members 11R combine to provide rigidity and structural strength.

Figure 4:
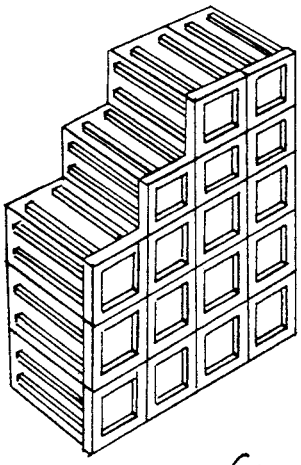
FIG. 4 shows an isometric view of a group of the storage containers of the present invention arranged as a storage wall.

Another feature of the rim portion 14 and rib members 11R according to the present invention (see FIG. 1) is that outer surfaces 14P of the rim member 14 and the outer surfaces 11P of the rib members 11R define mating surfaces around the outside of storage container which are parallel to each other. These parallel mating surfaces allow a plurality of storage containers 10 to be stacked together into a compact and attractive assemblages of desired formats. An example of such an assemblage is shown in FIG. 4. Another advantage of the storage container according to the present invention is that the arrangement of retaining ring 14 and cover 50 allows an individual container in a particular assemblage to be opened without removing it from the assemblage or otherwise disrupting the assemblage.

The cross-sectional view of FIG. 2 shows another advantageous feature of the structure of the storage container 10 according to the present invention. This feature is that each of the plurality of wall sections 11W is tapered in thickness from top to bottom so that the thickness of the wall section 11W at the bottom region 11X is relatively thinner than that at the top region 11Y. This structural feature provides an advantage when the storage container 10 according to the present invention is manufactured using automated manufacturing processes such as injection molding or automatic casting since the tapered wall section facilitates ejection from the mold.

A wide variety of materials can be used to manufacture the storage container 10 according to the present invention. In the preferred embodiment, a natural polypropylene structural foam is used to provide a durable, light-weight storage container which ca be inexpensively manufactured in a wide variety of colors using an automated injection molding process. Other materials are equally suitable. For example, the storage container 10 according to the present invention could be manufactured using plastic resins in an automatic casting process. Similarly, storage container 10 could be automatically cast in metal although material costs would be higher.

While the invention has been particularly shown and described with reference to a preferred embodiment thereof, it will be understood by those skilled in the art that changes in form and detail may be made therein without departing form the spirit and the scope of the invention. Thus, although the preferred embodiment for storage container 10 shown in FIGS. 1–4 is a rectangular vessel with four sides, the present invention can be applied to make vessels of other forms. For example, the present invention could be practiced to form a storage container having a triangular cross-section with a rim portion and rib members forming parallel mating surfaces to allow the formation of a plurality of containers as a storage wall with a concept similar to that shown in FIG. 4. Similarly, the present invention could be practiced to make storage containers having pentagonal cross-sections, hexagonal cross-sections, octagonal cross-sections, etc.

I claim:

1. A storage container for human remains comprising:

bottom means for forming the bottom of said container;

a plurality of wall means, each of said wall means having an outer surface, a bottom edge coupled to said bottom means, a first side edge coupled to an adjacent wall means, a second side edge coupled to adjacent wall means and a top edge for forming the walls of said container, each of said plurality of wall means having at least one external protruding rib integrally connected to an edge portion of said wall means and extending between said bottom means and said top edge;

rim means having an outer periphery, and a inner periphery which includes a recessed portion, said rim means coupled to said top edges of said plurality of wall means for forming the rim of said container;

cover means adapted to fit within said recessed portion for forming the cover which seals the top of said container;

retaining means having an outer periphery which physically corresponds to said outer periphery which physically corresponds to said outer periphery of said rim means for retaining said cover means within said recessed portion; and fastening means coupled to said retaining means and said rim means for fastening said retaining means to said cover means;

said container containing ashed human remains; and rim buttress means coupled to said rim means and coupled to said wall means for provided a structural transition between said rim means and said wall means.

2. A storage container for human remains comprising:

bottom means for forming the bottom of said container;

a plurality of wall means, each of said wall means having an outer surface, a bottom edge coupled to said bottom means, a first side edge coupled to an adjacent wall means, a second side edge coupled to adjacent wall means and a top edge for forming the walls of said container;

rim means having an outer periphery, and a inner periphery which includes a recessed portion, said rim means coupled to said top edges of said plurality of wall means for forming the rim of said container;

cover means adapted to fit within said recessed portion for forming the cover which seals the top of said container;

retaining means having an outer periphery which physically corresponds to said outer periphery of said rim means for retaining said cover means within said recessed portion;

fastening means coupled to said retaining means and said rim means for fastening said retaining means to said cover means;

said container containing ashed human remains; and rim buttress means coupled to said rim means and coupled to said wall means for providing a structural transition between said rim means and said wall means.

3. The storage container for human remains according to claim 2 further comprising:

a plurality of rib member means coupled to said rim buttress means and to said outer surface of said wall means for providing structural rigidity to said wall means.

4. The storage container for human remains according to claim 3 wherein said wall means tapers in thickness from a relatively thicker wall thickness at the coupling of said wall means to said rim means to a relatively thinner wall thickness at the coupling of said wall means to said bottom means.

5. The storage container for human remains according to claim 4 wherein said container is made of plastic.

6. The storage container for human remains according to claim 5 wherein said plastic is polypropylene structural foam.

7. The storage container for human remains according to claim 6 wherein said polypropylene structural foam is formed into said container using an automatic injection molding process.

8. The storage container for human remains according to claim 5 wherein said plastic is castable plastic resin.

9. The storage container for human remains according to claim 7 wherein said plastic is castable plastic resin formed into said container using an automatic casting process.

10. The storage container for human remains according to claim 4 wherein said container is made of metal formed into said container using an automatic casting process.

11. A method for making a storage container for human remains comprising the steps of:

providing bottom means for forming the bottom of said container;

providing a plurality of wall means, each of said wall means having an outer surface, a bottom edge coupled to said bottom means, a first side edge coupled to an adjacent wall means, a second side edge coupled to adjacent wall means and a top edge for forming the walls of said container;

providing at least one external protruding rib integrally connected to an edge portion of each of said plurality of wall means and extending between said bottom means and said top edge;

providing rim means having an outer periphery, and a inner periphery which includes a recessed portion, said rim means coupled to said top edges of said plurality of wall means for forming the rim of said container;

providing cover means adapted to fit within said recessed portion for forming the cover which seals the top of said container;

providing retaining means having an outer periphery which physically corresponds to said outer periphery of said rim means for retaining said cover means within said recessed portion; and providing fastening means coupled to said retaining means and said rim means for fastening said retaining means to said cover means; and providing rim buttress means coupled to said rim means and coupled to said wall means for providing a structural transition between said rim means and said wall means;

said container containing ashed human remains.

12. A method for making a storage container for human remains comprising the steps of:

providing bottom means for forming the bottom of said container;

providing a plurality of wall means, each of said wall means having an outer surface, a bottom edge coupled to said bottom means, a first side edge coupled to an adjacent wall means, a second side edge coupled to adjacent wall means and a top edge for forming the walls of said container;

providing rim means having an outer periphery, and a inner periphery which includes a recessed portion, said rim means coupled to said top edges of said plurality of wall means for forming the rim of said container;

providing cover means adapted to fit within said recessed portion for forming the cover which seals the top of said container;

providing retaining means having an outer periphery which physically corresponds to said outer periphery of said rim means for retaining said cover means within said recessed portion;

providing fastening means coupled to said retaining means and said rim means for fastening said retaining means to said cover means; said container containing ashed human remains; and providing rim buttress means coupled to said rim means and coupled to said wall means for providing a structural transition between said rim means and said wall means.

13. The method for providing the storage container for human remains according to claim 12 further comprising the step of:

providing a plurality of rib member means coupled to said rim buttress means and to said outer surface of said wall means for providing structural rigidity to said wall means.

14. The method for providing a storage container for human remains according to claim 13 wherein said wall means tapers in thickness from a relatively thicker wall thickness at the coupling of said wall means to said rim means to a relatively thinner wall thickness at the coupling of said wall means to said bottom means.

15. The method for providing a storage container for human remains according to claim 14 wherein said container is made of plastic.

16. The method for providing a storage container for human remains according to claim 15 wherein said plastic is polypropylene structural foam.

17. The method for providing a storage container for human remains according to claim 16 wherein said polypropylene structural foam is formed into said container using an automatic injection molding process.

18. The method for providing a storage container for human remains according to claim 15 wherein said plastic is castable plastic resin.

19. The method for providing a storage container for human remains according to claim 17 wherein said plastic is castable plastic resin formed into said container using an automatic casting process.

20. The method for providing a storage container for human remains according to claim 14 wherein said container is made of metal formed into said container using an automatic casting process.

21. A storage system for human remains comprising:

a one-piece container having a bottom, a plurality of walls each coupled to said bottom and to adjacent walls and a rim portion coupled to said walls, said rim portion having a recess;

a cover housed in said recess;

a retaining ring screwably coupled to said rim, said retaining ring holding said cover in said recess to seal said container;

rim buttress means coupled to said rim portion and coupled to said wall for providing a structural transition between said rim portion and said walls;

said container containing ashed human remains; and wherein said plurality of walls further comprise a rib members coupled to each outside wall surface to add structural rigidity to each wall.

22. The storage system for human remains according to claim 21 wherein said one-piece container is made of plastic using an automatic injection molding process.

23. The storage system for human remains according to claim 22 wherein said plastic is structural polypropylene foam.

24. The storage system for human remains according to claim 21 wherein said one-piece container is made of metal or castable plastic resin using an automatic casting process.

25. The storage system for human remains according to claim 21 wherein the outer surfaces of said rib members form parallel mating surfaces for said container so that a plurality of said containers can be stacked together to form a storage assemblage.

* * * * *

UNITED STATES PATENT AND TRADEMARK OFFICE

CERTIFICATE OF CORRECTION

PATENT NO. : 5,287,603

DATED : Feb. 22, 1994

INVENTOR(S) : David C. Schorman

It is certified that error appears in the above-identified patent and that said Letters Patent is hereby corrected as shown below:

IN THE CLAIMS:

Col. 4,

Claim 1, lines 24-25, delete "which physically corresponds to said outer periphery"

Col. 5,

Claim 8, line 2, change "5" to -- 4--.

Col. 6,

Claim 19, line 2, change "17" to --18 --.

Signed and Sealed this

Twenty-ninth Day of August, 1995

Bruce Lehman

*Attest:*

BRUCE LEHMAN

*Attesting Officer*

*Commissioner of Patents and Trademarks*